US009745980B2

(12) United States Patent
Hirayama

(10) Patent No.: US 9,745,980 B2
(45) Date of Patent: Aug. 29, 2017

(54) HERMETIC-TYPE COMPRESSOR AND REFRIGERATION CYCLE APPARATUS

(71) Applicant: Toshiba Carrier Corporation, Kawasaki-shi, Kanagawa (JP)

(72) Inventor: Takuya Hirayama, Fuji (JP)

(73) Assignee: Toshiba Carrier Corporation, Kawasaki-shi, Kanagawa (JP)

( * ) Notice: Subject to any disclaimer, the term of this patent is extended or adjusted under 35 U.S.C. 154(b) by 517 days.

(21) Appl. No.: 14/348,553

(22) PCT Filed: Sep. 20, 2012

(86) PCT No.: PCT/JP2012/074008

§ 371 (c)(1),
(2) Date: Mar. 28, 2014

(87) PCT Pub. No.: WO2013/047307

PCT Pub. Date: Apr. 4, 2013

(65) Prior Publication Data

US 2014/0250937 A1 Sep. 11, 2014

(30) Foreign Application Priority Data

Sep. 29, 2011 (JP) ..... 2011 215028
Jul. 27, 2012 (JP) ..... 2012 167189

(51) Int. Cl.
*F04C 29/06* (2006.01)
*F04C 23/00* (2006.01)
(Continued)

(52) U.S. Cl.
CPC ..... *F04C 29/065* (2013.01); *F04C 18/356* (2013.01); *F04C 23/001* (2013.01);
(Continued)

(58) Field of Classification Search
CPC .. F04C 18/356; F04C 2240/60; F04C 23/001; F04C 23/008; F04C 28/24; F04C 29/065;
(Continued)

(56) References Cited

U.S. PATENT DOCUMENTS 6,102,677 A * 8/2000 Iida ..... F04C 18/10 417/410.3
2004/0071576 A1* 4/2004 Matsumoto ..... F04C 23/008 418/11

(Continued)

FOREIGN PATENT DOCUMENTS

CN 1676938 10/2005
JP H01-301984 12/1989

(Continued)

OTHER PUBLICATIONS

International Preliminary Report on Patentability issued in PCT/JP2012/074008 dated Apr. 1, 2014 with English Language Translation.

(Continued)

*Primary Examiner* — Dominick L Plakkoottam
(74) *Attorney, Agent, or Firm* — DLA Piper LLP US

(57) ABSTRACT

A compression mechanism portion housed in a closed case is provided with a partition plate located between a first cylinder and a second cylinder. The compression mechanism includes a first bearing discharge port formed to a first bearing and a first partition plate discharge port formed to the partition plate as discharge ports for discharging working fluid compressed in a first cylinder chamber, and also includes, as discharge port for discharging working fluid compressed in a second cylinder chamber, a second bearing discharge port formed to a second bearing and a second partition plate discharge port formed to the partition plate. A cross-sectional area of the first partition plate discharge port is formed to be smaller than a cross-sectional area of the first (Continued)

bearing discharge port, and a cross-sectional area of the second partition plate discharge port is formed to be smaller than a cross-sectional area of the second bearing discharge port.

18 Claims, 4 Drawing Sheets

(51) Int. Cl.

| | |
|---|---|
| ***F04C 28/24*** | (2006.01) |
| ***F25B 1/00*** | (2006.01) |
| ***F04C 29/00*** | (2006.01) |
| ***F04C 29/12*** | (2006.01) |
| ***F04C 18/356*** | (2006.01) |

(52) U.S. Cl.
CPC ..... *F04C 23/008* (2013.01); *F04C 29/0035* (2013.01); *F04C 29/12* (2013.01); *F25B 1/005* (2013.01); *F04C 28/24* (2013.01); *F04C 2240/60* (2013.01)

(58) Field of Classification Search
CPC .... F04C 29/12; F04C 29/0035; F04C 29/061; F04C 29/068; F01C 21/02; F01C 21/0863; Y10S 417/902; F25B 1/005
See application file for complete search history.

(56) References Cited

U.S. PATENT DOCUMENTS

2006/0056987 A1* 3/2006 Seok ..... F04C 18/3564 417/273
2011/0067434 A1* 3/2011 Miura ..... F01C 21/02 62/498

FOREIGN PATENT DOCUMENTS

| | | |
|---|---|---|
| JP | 02-063093 U | 5/1990 |
| JP | H02-230994 | 9/1990 |
| JP | H10-213087 | 8/1998 |
| WO | WO 2009/145232 | 12/2009 |

OTHER PUBLICATIONS

English Language Abstract for JP H01-301984 published Dec. 6, 1989.
English Language Abstract for JP H02-230994 published Sep. 13, 1990.
English Language Abstract and Translation for JP H10-213087 published Aug. 11, 1998.
English Language Abstract for CN1676938 published Oct. 5, 2005.
International Search Report issued in PCT/JP2012/074008 dated Dec. 4, 2012.

* cited by examiner

HERMETIC-TYPE COMPRESSOR AND REFRIGERATION CYCLE APPARATUS

CROSS REFERENCE TO RELATED APPLICATIONS

This application is a U.S. National Stage Application of International Application No. PCT/JP2012-074008 filed Sep. 20, 2012, which claims priority from Japanese Patent Application No. 2011/215028 filed Sep. 29, 2011 and Japanese Patent Application No. 2012/167189 filed Jul. 27, 2012. The entirety of all the above-listed applications are incorporated herein.

TECHNICAL FIELD

Embodiments of the present invention relate to a hermetic-type compressor and a refrigeration cycle apparatus using the hermetic-type compressor.

BACKGROUND ART

There is known, as an example, a hermetic-type compressor such as disclosed in Patent Documents 1 and 2, in which an hermetic-type compressor has a motor section and a compression mechanism section driven by a rotating shaft coupled to the motor section that are housed in a closed case, and also has one pair of upper and lower cylinders with a partition plate disposed therebetween and in the compression mechanism section, and such hermetic-type compressor compresses a gas refrigerant (working fluid) in cylinder chambers formed in the respective cylinders and discharges the gas refrigerant into a space in the sealed case.

In the hermetic-type compressor disclosed in Patent Document 1, discharge ports are formed in a partition plate, and a gas refrigerant compressed in cylinder chambers is discharged into a space in a closed case through the discharge ports.

In the hermetic-type compressor disclosed in Patent Document 2, discharge ports are formed in bearings which rotatably support a rotating shaft and in a partition plate, and a gas refrigerant compressed in cylinder chambers is discharged into a space in a closed case through the discharge ports.

PRIOR ART DOCUMENTS

Patent Documents

Patent Document 1: Japanese Patent Laid-open Publication No. 10-213087

Patent Document 2: International Publication No. WO 2009/145232

SUMMARY OF THE INVENTION

Problem to be Solved by the Invention

In the hermetic-type compressor disclosed in Patent Document 1, however, the discharge ports are formed only in the partition plate. Therefore, with increase in the amount of gas refrigerant discharged, pressure loss produced when the gas refrigerant passes through the discharge ports increases. The increase results in degradation in performance of the hermetic-type compressor.

In the hermetic-type compressor disclosed in Patent Document 2, the discharge ports are formed in the partition plate and the bearings. Even if the amount of gas refrigerant discharged increases, pressure loss produced when the gas refrigerant passes through the discharge ports can be kept down. However, the Patent Document 2 fails to mention a cross-sectional area of each discharge port formed in the partition plate and a cross-sectional area of each discharge port formed in the bearings. If the cross-sectional area of each discharge port formed in the partition plate and the cross-sectional area of each discharge port formed in the bearings are equal to each other, in order to dampen pressure pulsation of the gas refrigerant discharged into the muffler chamber of the partition plate through the discharge ports of the partition plate, volume of a muffler chamber formed in the partition plate needs to be equalized with volume of a muffler chamber for a gas refrigerant discharged through the discharge port of each bearing. This need increases thickness of the partition plate, and such increase in the thickness of the partition plate leads to increase in an interval between the bearings, which causes uneven contact of the rotating shaft with the bearings and flexure of the rotating shaft. The uneven contact of the rotating shaft with the bearings and the flexure of the rotating shaft may result in degradation in the performance of the hermetic-type compressor.

In a hermetic-type compressor having a partition plate, one pair of eccentric portions is formed at a rotating shaft, a coupling portion is formed between the eccentric portions, and an insertion portion, in which such coupling portion between the eccentric portions is inserted, is formed at a middle of the partition plate. If a discharge port and a muffler chamber are formed in the partition plate, a thickness dimension along an axial direction of the rotating shaft of the partition plate increases. This increasing in the thickness dimension of the partition plate results in increasing in a length dimension along the axial direction of the rotating shaft of the coupling portion between eccentric portions. When the rotating shaft rotates, the coupling portion is likely to cause flexure, which will degrade rigidity of the rotating shaft.

One possible way to prevent such flexure of the coupling portion between the eccentric portions and enhance the rigidity of the rotating shaft is to make large the diameter of the coupling portion. However, securement of a sufficient volume for the muffler chamber in the partition plate prevents a diameter of the insertion portion from becoming larger, and by limiting a size of the insertion portion, the coupling portion between the eccentric portions is restricted from becoming larger in the diameter.

It is an object of the present invention, which has been made in consideration of the above-described conventional techniques, to provide a hermetic-type compressor which is capable of suppressing pressure loss produced when a working fluid compressed in a cylinder chamber passes through a discharge port, capable of dampening pressure pulsation of the working fluid discharged through a discharge port of a partition plate so as to achieve reduction in thickness of the partition plate, and capable of making larger a diameter of a coupling portion between eccentric portions (inter-eccentric-portion coupling portion) of a rotating shaft to thereby enhance rigidity of the rotating shaft, and also provide a refrigeration cycle apparatus using the hermetic-type compressor.

Means for Solving the Problem

A hermetic type compressor according to the embodiment of the present invention to achieve the above object comprises a closed case, a motor portion which is housed in the closed case, and a compression mechanism portion which is housed in the closed case and is driven by a rotating shaft coupled to the motor portion, the compression mechanism portion including a first bearing, a first cylinder, a partition plate, a second cylinder, and a second bearing, which are provided in order along an axial direction of the rotating shaft, and having a first cylinder chamber formed in the first cylinder closed at two ends by the first bearing and the partition plate so as to compress a working fluid and a second cylinder chamber formed in the second cylinder closed at two ends by the partition plate and the second bearing so as to compress a working fluid, in which the working fluid compressed in the first cylinder chamber and the working fluid compressed in the second cylinder chamber are discharged into a space in the closed case, wherein an in-partition-plate space which communicates with the space in the closed case is formed inside the partition plate, the compressor is provided, as discharge ports through which the working fluid compressed in the first cylinder chamber is discharged into the space in the closed case, with a first bearing discharge port formed in the first bearing and a first partition plate discharge port formed in the partition plate, the compressor is provided, as discharge ports through which the working fluid compressed in the second cylinder chamber is discharged into the space in the closed case, with a second bearing discharge port formed in the second bearing and a second partition plate discharge port formed in the partition plate, and a cross-sectional area of the first partition plate discharge port is formed to be smaller than a cross-sectional area of the first bearing discharge port, and a cross-sectional area of the second partition plate discharge port is formed to be smaller than a cross-sectional area of the second bearing discharge port.

In the above embodiment, it may be desired that the rotating shaft has eccentric portions, which are located in the first and second cylinder chambers, have centers deviating from a rotation center of the rotating shaft, rollers are fitted to outer peripheral portions of the eccentric portions, and an inter-eccentric-portion coupling portion, which is located between the eccentric portions, and has a center coincident with the rotation center of the rotating shaft, that the partition plate is formed by coupling a plurality of divisional partition plates as divided portions along the axial direction of the rotating shaft, the partition plate having an insertion portion in which the inter-eccentric-portion coupling portion is inserted, and the inter-eccentric-portion coupling portion is formed in a solid cylinder shape having a radius dimension "Rj" larger than "Dp-Rc-e" and smaller than "Dp/2," where "Rc" is a radius dimension of each of the eccentric portions, "Dp" is an inner diameter dimension of the insertion portion, and "e" is an eccentricity which is a distance from the rotation center of the rotating shaft to the center of each eccentric portion, and that escape portions, which provide a shape not protruding in outer peripheral directions from the eccentric portions and have dimensions along the axial direction of the rotating shaft which are smaller than a thickness dimension of the partition plate, are formed at portions facing the eccentric portions of an outer peripheral portion of the inter-eccentric-portion coupling portion.

In the above embodiment, it may be desired that a discharge valve which opens or closes the first partition plate discharge port has a maximum degree of opening that is set to be smaller than a maximum degree of opening of a discharge valve which opens or closes the first bearing discharge port, and a discharge valve which opens or closes the second partition plate discharge port has a maximum degree of opening is set to be smaller than a maximum degree of opening of a discharge valve which opens or closes the second bearing discharge port.

In the above embodiment, it may be desired that the first cylinder is arranged above the second cylinder, that a first muffler chamber which communicates with the first bearing discharge port and a second muffler chamber which communicates with the second bearing discharge port are provided, that a first discharge passage communicating the in-partition-plate space and the first muffler chamber with each other and a second discharge passage communicating the in-partition-plate space and the second muffler chamber with each other are provided, and that a cross-sectional area of the first discharge passage is formed to be larger than a cross-sectional area of the second discharge passage.

In the above embodiment, it may be desired that the partition plate is formed by coupling divisional partition plates divided into two portions along the axial direction of the rotating shaft, a positioning member having two protruding ends is provided at one of the divisional partition plates, and engagement portions to be engaged with the positioning member are formed at another one of the divisional partition plates and the first cylinder or the second cylinder.

In the above embodiment, it may be desired that the escape portions are formed on a side where the motor section is attached and a side opposite to the first mentioned side along the axial direction of the rotating shaft, and the dimensions along the axial direction of the rotating shaft of the escape portions are formed such that the dimension of one of the escape portions located on the side where the motor section is attached is larger than the dimension of another one of the escape portions located on the side opposite to the first mentioned side.

In another embodiment of the present invention, there is provided a refrigerant cycle apparatus which comprises a hermetic-type compressor of the structures or configurations mentioned above, a condenser which is connected to the hermetic-type compressor, an expansion device which is connected to the condenser, and an evaporator which is connected between the expansion device and the hermetic-type compressor.

Effects of the Invention

According to the hermetic-type compressor according to the embodiment of the present invention which has the above-described features, the pressure loss produced when a working fluid compressed in a cylinder chamber passes through a discharge port can be suppressed, the pressure pulsation of a working fluid discharged through a discharge port of a partition plate to achieve reduction in thickness of the partition plate can be suppressed, and a diameter of an inter-eccentric-portion coupling portion of a rotating shaft can be made larger to enhance rigidity of the rotating shaft. A refrigeration cycle apparatus provided with such hermetic-type compressor can provide a more compact structure having high refrigeration accuracy.

DESCRIPTION OF THE PREFERRED EMBODIMENT

First Embodiment

Figure 1:
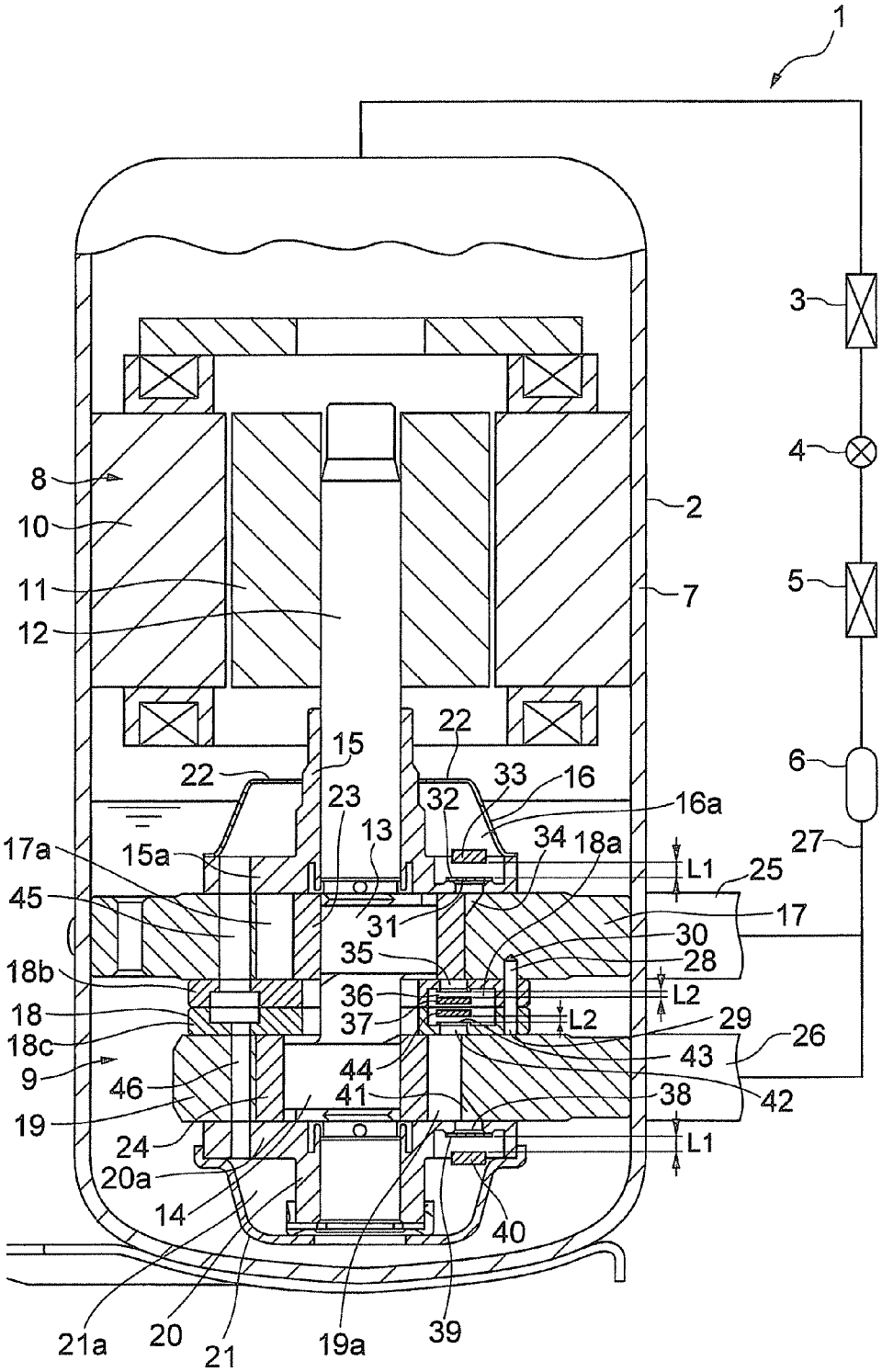
FIG. 1 is a schematic partial sectional view of a refrigeration cycle apparatus including a hermetic-type compressor according to a first embodiment of the present invention.

A first embodiment will be described hereunder with reference to FIG. 1. As shown in FIG. 1, a refrigeration cycle apparatus 1 has a hermetic-type compressor 2, a condenser 3 which is connected to the hermetic-type compressor 2, an expansion device 4 which is connected to the condenser 3, an evaporator 5 which is connected to the expansion device 4, and an accumulator 6 which is connected between the evaporator 5 and the hermetic-type compressor 2.

In the refrigeration cycle apparatus 1, a refrigerant serving as a working fluid circulates while changing in phase between a gas refrigerant in gaseous form and a liquid refrigerant in liquid form. The refrigerant dissipates heat in a phase change process from a gas refrigerant to a liquid refrigerant and absorbs heat in a phase change process from a liquid refrigerant to a gas refrigerant. The heat dissipation and heat absorption are utilized to perform air-heating, air-cooling, heating, cooling, and the like.

The hermetic-type compressor 2 has an airtight closed case 7 which is formed in a substantially hollow cylindrical shape, and a motor section 8 and a compression mechanism section 9 which compresses a gas refrigerant are housed in the closed case 7. The closed case 7 is installed vertically with a center of a hollow cylinder in a vertical direction. The motor section 8 is arranged on an upper side within the closed case 7, and the compression mechanism section 9 is arranged below the motor section 8. A lubricating oil is accumulated at a bottom portion in the closed case 7. A space in the closed case 7 is filled with a high-pressure gas refrigerant compressed by the compression mechanism section 9.

The motor section 8 has a stator 10, a rotor 11 and a rotating shaft 12. The stator 10 is formed in a hollow cylindrical shape and is fixed to an inner peripheral portion of the closed case 7 by means shrink fitting, press fitting, welding, or the like. The rotor 11 is rotatably inserted in the stator 10, and the rotating shaft 12 is fitted in the rotor 11 at the center portion thereof, so that the rotating shaft 12 and the rotor 11 rotate together.

The rotating shaft 12 has two eccentric portions 13 and 14 in a cylindrical shape which are formed to protrude toward an outer periphery of the rotating shaft 12. The eccentric portions 13 and 14 are formed at positions spaced apart with a set dimension along an axial direction of the rotating shaft 12 and are formed at positions spaced apart by 180° along a rotation direction of the rotating shaft 12.

The compression mechanism section 9 is a portion which is driven by the rotating shaft 12 of the motor section 8 and compresses a low-pressure gas refrigerant into a high-pressure, high-temperature gas refrigerant. The compression mechanism section 9 includes a first bearing 15, a first muffler case 16, a first cylinder 17, a partition plate 18, a second cylinder 19, a second bearing 20, and a second muffler case 21, which are provided in the described order along the axial direction of the rotating shaft 12.

The first bearing 15 is fixed to the first cylinder 17, and the second bearing 20 is fixed to the second cylinder 19. The first bearing 15 and the second bearing 20 rotatably support the rotating shaft 12.

The first muffler case 16 is a hollow case which is fixed to the first bearing 15 and surrounds the first bearing 15. A first muffler chamber 16*a* is formed inside the first muffler case 16. An interior of the first muffler chamber 16*a* and the space in the closed case 7 communicate with each other through a plurality of communication holes 22 which are formed in the first muffler case 16. The communication holes 22 are located above a liquid level of the lubricating oil accumulated in the closed case 7.

The second muffler case 21 is a hollow case which is fixed to the second bearing 20 and surrounds the second bearing 20. A second muffler chamber 21*a* is formed inside the second muffler case 21.

The first cylinder 17 is provided to be fixed in position to an interior of the closed case 7. A first cylinder chamber 17*a* is formed in the first cylinder 17, the first cylinder chamber 17*a* being closed at an upper end by a flange portion 15*a* of the first bearing 15 and also closed at a lower end by the partition plate 18.

The second cylinder 19 is provided to be fixed in position to the first cylinder 17. A second cylinder chamber 19*a* is formed in the second cylinder 19, the second cylinder chamber 19*a* being at an upper end by the partition plate 18 and also closed at a lower end by a flange portion 20*a* of the second bearing 20.

The rotating shaft 12 is inserted in the first and second cylinder chambers 17*a* and 19*a*. The eccentric portion 13 that is one of the eccentric portions formed at the rotating shaft 12 is located in the first cylinder chamber 17*a*, while the eccentric portion 14 that is another of the eccentric portions formed at the rotating shaft 12 is located in the second cylinder chamber 19*a*. A roller 23 is fitted on the one eccentric portion 13, while a roller 24 is fitted on the another eccentric portion 14. With rotation of the rotating shaft 12, the rollers 23 and 24 roll in the first and second cylinder chambers 17*a* and 19*a* while bringing outer peripheral surfaces into partial contact with inner peripheral surfaces of the first and second cylinder chambers 17*a* and 19*a*. Respective blades (not shown) are slidably provided in the first and second cylinder chambers 17*a* and 19*a*. Distal end portions of the blades are biased by biasing members, such as springs, to be in contact with the outer peripheral surfaces of the rollers 23 and 24.

According to the configuration in which the outer peripheral surfaces of the rollers 23 and 24 are made to be in partial contact with the inner peripheral surfaces of the first and second cylinder chambers 17*a* and 19*a* and the distal end portions of the blades are made to be in contact with the outer peripheral surfaces of the rollers 23 and 24, the interiors of the first and second cylinder chambers 17*a* and 19*a* are each partitioned into two spaces, which vary in volume in response to rolling of the roller 23 or 24. When the compression mechanism section 9 is driven, a gas refrigerant flows into one of the spaces, and volume of the space becomes smaller with rolling of the roller 23 or 24, thereby compressing the gas refrigerant in the space. The compressed gas refrigerant is discharged into the first muffler chamber 16*a*, the second muffler chamber 21*a*, and a muffler chamber 18*a* disposed inside the partition plate (to be described later) and is then guided into the space in the closed case 7.

A first inlet port 25 for sucking a low-pressure gas refrigerant into the first cylinder chamber 17*a* is provided at the first cylinder 17, and a second inlet port 26 for sucking a low-pressure gas refrigerant into the second cylinder chamber 19*a* is provided at the second cylinder 19. A suction pipe 27 through which a low-pressure gas refrigerant flows is provided between the first and second inlet ports 25 and 26 and the accumulator 6.

The partition plate 18 divides the first cylinder 17 and the second cylinder 19 from each other, and the muffler chamber 18*a* as in-partition-plate chamber that is formed as inside space of the partition plate 18. The partition plate 18 is formed by coupling, along the axial direction of the rotating shaft 12, a first divisional partition plate 18*b* and a second divisional partition plate 18*c* divided into two parts. The first divisional partition plate 18*b* is located on the first cylinder 17 side, while the second divisional partition plate 18*c* is located on the second cylinder 19 side. A positioning member 28 which protrudes toward two end faces along the axial direction of the rotating shaft 12 is fixed to the first divisional partition plate 18*b*. An engagement portion 29 with which the positioning member 28 is to be engaged is formed at the second divisional partition plate 18*c*. According to the structure in which one end of the positioning member 28 is engaged with the engagement portion 29, the first divisional partition plate 18*b* and the second divisional partition plate 18*c* are positioned. An engagement portion 30 is formed at a portion facing the first divisional partition plate 18*b* of the first cylinder 17. Another end of the positioning member 28 is engaged with the engagement portion 30, and the first cylinder 17 and the partition plate 18 are hence positioned.

It is to be noted that the first cylinder 17 and the second cylinder 19 are positionally fixed in advance and that the second cylinder 19 and the partition plate 18 are positioned when the first cylinder 17 and the partition plate 18 are positioned.

A structure for guiding a gas refrigerant compressed in the first cylinder chamber 17*a* and the second cylinder chamber 19*a* into the space in the closed case 7 will be described hereunder.

A first bearing discharge port 31 through which a gas refrigerant compressed in the first cylinder chamber 17*a* is discharged into the first muffler chamber 16*a* is formed in the flange portion 15*a* of the first bearing 15. The first bearing discharge port 31 is communicated with the first cylinder chamber 17*a* at a predetermined timing in association with the rotation of the rotating shaft 12. The flange portion 15*a* is also provided with a discharge valve 32 which opens or closes the first bearing discharge port 31 and a valve guard 33 which restrains a maximum degree of opening "L1" of the discharge valve 32. A notch groove 34 is formed at a portion facing the first bearing discharge port 31 of the first cylinder 17.

A first partition plate discharge port 35 through which a gas refrigerant compressed in the first cylinder chamber 17*a* is discharged into the in-partition-plate muffler chamber 18*a* is formed in the first divisional partition plate 18*b*. The first partition plate discharge port 35 is made to communicate with the first cylinder chamber 17*a* at a predetermined timing in association with the rotation of the rotating shaft 12. The partition plate 18 is also provided with a discharge valve 36 which opens or closes the first partition plate discharge port 35 and a valve guard 37 which restrains a maximum degree of opening "L2" of the discharge valve 36.

A second bearing discharge port 38 through which a gas refrigerant compressed in the second cylinder chamber 19*a* is discharged into the second muffler chamber 21*a* is formed in the flange portion 20*a* of the second bearing 20. The second bearing discharge port 38 is made to communicate with the second cylinder chamber 19*a* at a predetermined timing in association with the rotation of the rotating shaft 12. The flange portion 20*a* is also provided with a discharge valve 39 which opens or closes the second bearing discharge port 38 and a valve guard 40 which restrains the maximum degree of opening "L1" of the discharge valve 39. A notch groove 41 is formed at a portion facing the second bearing discharge port 38 of the second cylinder 19.

A second partition plate discharge port 42 through which a gas refrigerant compressed in the second cylinder chamber 19*a* is discharged into the in-partition-plate muffler chamber 18*a* is formed in the second divisional partition plate 18*c*. The second partition plate discharge port 42 is made to communicate with the second cylinder chamber 19*a* at a predetermined timing in association with the rotation of the rotating shaft 12. The partition plate 18 is also provided with a discharge valve 43 which opens or closes the second partition plate discharge port 42 and a valve guard 44 which restrains the maximum degree of opening "L2" of the discharge valve 43.

A cross-sectional area of the first partition plate discharge port 35 is formed to be smaller than a cross-sectional area of the first bearing discharge port 31. The maximum degree of opening "L2" of the discharge valve 36 that opens or closes the first partition plate discharge port 35 is formed to be smaller than the maximum degree opening "L1" of the discharge valve 32 that opens or closes the first bearing discharge port 31.

Similarly, a cross-sectional area of the second partition plate discharge port 42 is formed to be smaller than a cross-sectional area of the second bearing discharge port 38. The maximum degree of opening "L2" of the discharge valve 43 that opens or closes the second partition plate discharge port 42 is formed to be smaller than the maximum degree of opening "L1" of the discharge valve 39 that opens or closes the second bearing discharge port 38.

The first muffler chamber 16*a*, the in-partition-plate muffler chamber 18*a*, and the second muffler chamber 21*a* communicate with one another. A first discharge passage 45 is provided so as to communicate the first muffler chamber 16*a* and the in-partition-plate muffler chamber 18*a* with each other. The first discharge passage 45 is formed so as to extend through the first divisional partition plate 18*b*, the first cylinder 17, and the flange portion 15*a* of the first bearing 15. A second discharge passage 46 is also provides so as to communicate the second muffler chamber 21*a* and the in-partition-plate muffler chamber 18*a* with each other. The second discharge passage 46 is formed to extend through the flange portion 20*a* of the second bearing 20, the second cylinder 19, and the second divisional partition plate 18*c*. A cross-sectional area of the first discharge passage 45 is formed to be larger than a cross-sectional area of the second discharge passage 46.

In the condenser 3, a gas refrigerant guided from the space in the closed case 7 is condensed into a liquid refrigerant.

Next, in the expansion device 4, the liquid refrigerant obtained through the condensation in the condenser 3 is decompressed.

Then, in the evaporator 5, the liquid refrigerant decompressed in the expansion device 4 evaporates into a gas refrigerant.

Furthermore, in the accumulator 6, if a liquid refrigerant is included in the gas refrigerant obtained through the evaporation in the evaporator 5, the liquid refrigerant is removed.

In the above-described configuration, when the motor section 8 is driven to rotate the rotating shaft 12, a low-pressure gas refrigerant passing through the accumulator 6 goes through the suction pipe 27 and is sucked into the first and second cylinder chambers 17*a* and 19*a* through the first and second inlet ports 25 and 26. The sucked gas refrigerant is compressed.

A gas refrigerant compressed in the first cylinder chamber 17*a* is discharged through the first bearing discharge port 31 and the first partition plate discharge port 35, and the total area of the discharge ports, through which the compressed gas refrigerant is discharged from the first cylinder chamber 17*a*, becomes large. Thus, even if the large amount of gas refrigerant is discharged from the first cylinder chamber 17*a*, the pressure loss produced at a time when the compressed gas refrigerant passes through the first bearing discharge port 31 and the first partition plate discharge port 35 can be suppressed, thus enhancing the performance of the hermetic-type compressor 2.

A gas refrigerant compressed in the second cylinder chamber 19*a* is discharged through the second bearing discharge port 38 and the second partition plate discharge port 42, and the total area of the discharge ports, through which the compressed gas refrigerant is discharged from the second cylinder chamber 19*a*, becomes large. Thus, even if the large amount of gas refrigerant is discharged from the second cylinder chamber 19*a*, the pressure loss produced at a time when the compressed gas refrigerant passes through the second bearing discharge port 38 and the second partition plate discharge port 42 can suppressed, thus enhancing the performance of the hermetic-type compressor 2.

The cross-sectional area of the first partition plate discharge port 35 is formed to be smaller than the cross-sectional area of the first bearing discharge port 31, and the cross-sectional area of the second partition plate discharge port 42 is formed to be smaller than the cross-sectional area of the second bearing discharge port 38. According to such configuration, the amount of gas refrigerant discharged into the in-partition-plate muffler chamber 18*a* through the first partition plate discharge port 35 and the second partition plate discharge port 42 becomes smaller. Even if volume of the in-partition-plate muffler chamber 18*a* is small, the pressure pulsation of a gas refrigerant discharged into the in-partition-plate muffler chamber 18*a* can be dampened, and the generation of noise caused by pressure pulsation can be suppressed.

Moreover, the reduction in the volume of the in-partition-plate muffler chamber 18*a* allows the thickness of the partition plate 18 to be reduced. Thus, an interval between the first bearing 15 and the second bearing 20 can be reduced. The reduction in the interval between the first bearing 15 and the second bearing 20 can prevent the uneven contact of the rotating shaft 12 with the first bearing 15 and the second bearing 20 and also prevent the flexure of the rotating shaft 12, thereby enhancing the performance of the hermetic-type compressor 2.

The maximum degree of opening "L2" of the discharge valve 36 provided for the first partition plate discharge port 35 is formed to be smaller than the maximum degree of opening "L1" of the discharge valve 32 provided for the first bearing discharge port 31, and the maximum degree of opening "L2" of the discharge valve 43 provided for the second partition plate discharge port 42 is formed to be smaller than the maximum degree of opening "L1" of the discharge valve 39 provided for the second bearing discharge port 38. Because of such setting as mentioned above, the thickness of the partition plate 18 can be made further thinner, thereby more reliably preventing the uneven contact of the rotating shaft 12 with the first bearing 15 and the second bearing 20 and the flexure of the rotating shaft 12.

The notch groove 34 is formed at the portion facing the first bearing discharge port 31 of the first cylinder 17, and the notch groove 41 is formed at the portion facing the second bearing discharge port 38 of the second cylinder 19. Thus, the gas refrigerant can be smoothly discharged through the first bearing discharge port 31 and the second bearing discharge port 38 in a last phase of a gas refrigerant compression process.

A gas refrigerant discharged into the second muffler chamber 21*a* flows through the second discharge passage 46 and is guided into the in-partition-plate muffler chamber 18*a*. The gas refrigerant discharged into the second muffler chamber 21*a* and the gas refrigerant discharged into the in-partition-plate muffler chamber 18*a* flow through the first discharge passage 45 and are guided into the first muffler chamber 16*a*. Thus, the gas refrigerant flowing through the first discharge passage 45 is larger in amount than a gas refrigerant flowing through the second discharge passage 46.

In the cross-sectional area of the first discharge passage 45 and the cross-sectional area of the second discharge passage 46, the cross-sectional area of the first discharge passage 45 is formed to be larger than the cross-sectional area of the second discharge passage 46. Thus, even if the amount of gas refrigerant flowing through the first discharge passage 45 becomes larger than the amount of gas refrigerant flowing through the second discharge passage 46, the gas refrigerant flows smoothly through the first discharge passage 45.

The gas refrigerant in the first muffler chamber 16*a* is guided into the space in the closed case 7 through the communication holes 22 formed in the first muffler case 16. Since the communication holes 22 are formed above an oil level of the lubricating oil accumulated in the closed case 7, foaming in the lubricating oil caused by the gas refrigerant guided into the space in the closed case 7 through the communication holes 22 (i.e., phenomenon in which the refrigerant produces foam to cause the lubricating oil to foam up), and the foamed lubricating oil together with the gas refrigerant can be suppressed from being discharged to outside the closed case 7.

The partition plate 18 is formed by coupling the two divided members, the first divisional partition plate 18*b* and the second divisional partition plate 18*c*, and accordingly, the formation of the in-partition-plate muffler chamber 18*a* and the provision of the valve guards 37 and 44 in the partition plate 18 can be facilitated.

When the first divisional partition plate 18*b* and the second divisional partition plate 18*c* are to be coupled, the first and second divisional partition plates 18*b* and 18*c* can be reliably coupled in position by engaging the one end of the positioning member 28 fixed to the first divisional partition plate 18*b* with the engagement portion 29 formed at the second divisional partition plate 18*c*. Furthermore, the partition plate 18 can be coupled to the first cylinder 17 and the second cylinder 19 in position by engaging the another end of the positioning member 28 with the engagement portion 30 of the first cylinder 17.

Second Embodiment

A second embodiment of the present invention will be described hereunder with reference to FIGS. 2 and 3. It is further to be noted that the same components in the second embodiment and a third embodiment (to be described below) as those described in the first embodiment are denoted by the same reference numerals and redundant description will be omitted herein.

A basic configuration of a hermetic-type compressor 2A according to the second embodiment is the same as that of the hermetic-type compressor 2 according to the first embodiment. A motor section 8 (see FIG. 1), a compression mechanism section 9, and a rotating shaft 12 are housed in a closed case 7.

The compression mechanism section 9 includes a first bearing 15, a first cylinder 17, a partition plate 18, a second cylinder 19, and a second bearing 20, which are provided in order along an axial direction of the rotating shaft 12.

The rotating shaft 12 has an eccentric portion 13 in a solid cylindrical shape which is located in a first cylinder chamber 17*a*, a center of which deviates from a rotation center "X" of the rotating shaft 12, and which has a roller 23 fitted on an outer peripheral portion, an eccentric portion 14 in a solid cylindrical shape which is located in a second cylinder chamber 19*a* having a center deviated from the rotation center "X" of the rotating shaft 12, and having a roller 24 fitted on an outer peripheral portion, and a coupling portion 47 between the two eccentric portions (i.e., an inter-eccentric-portion coupling portion 47) which is located between the two eccentric portions 13 and 14 so as to couple the eccentric portions 13 and 14. The inter-eccentric-portion coupling portion 47 is formed in a solid cylindrical shape, has a center which coincides with the rotation center "X" of the rotating shaft 12, and has an escape (relief) portion (to be described later) formed at an outer peripheral portion.

The partition plate 18 is formed by coupling, along the axial direction of the rotating shaft 12, a first divisional partition plate 18*b* and a second divisional partition plate 18*c* which are two divided parts. As shown in FIG. 1, an in-partition-plate muffler chamber 18*a*, a first partition plate discharge port 35, and a second partition plate discharge port 42 are formed in the partition plate 18. An insertion portion 48 in which the inter-eccentric-portion coupling portion 47 is inserted is formed at a middle portion of the partition plate 18.

Figure 2:
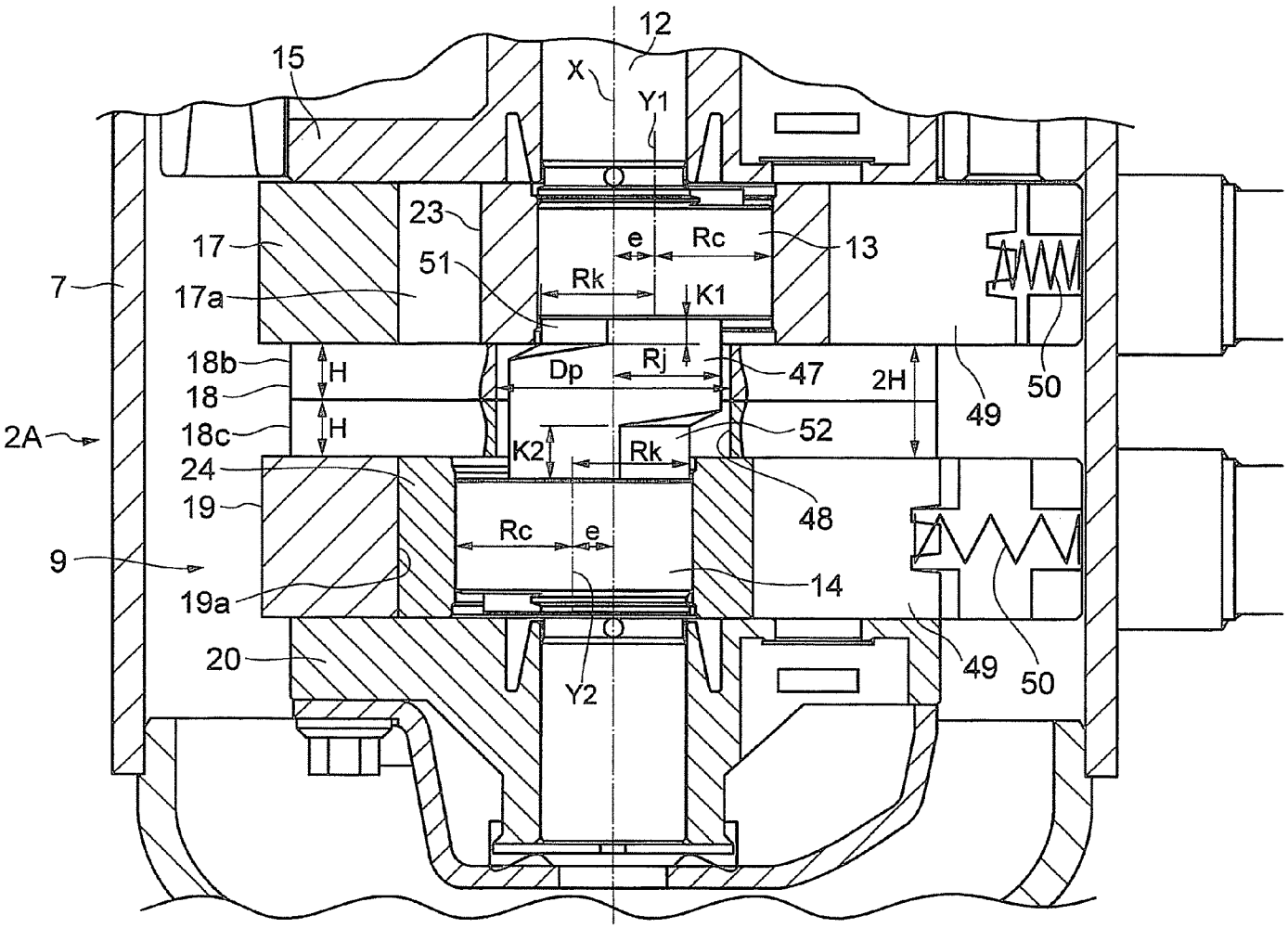
FIG. 2 is a vertical sectional view showing a portion of a hermetic-type compressor according to a second embodiment of the present invention.

Further, blades 49 and springs 50 serving as biasing members, which are not shown in FIG. 1, are shown in FIG. 2. Distal end portions of the blades 49 are biased by the springs 50 to be in contact with outer peripheral surfaces of the rollers 23 and 24. By the blades 49, the interiors of the first and second cylinder chambers 17*a* and 19*a* are each subdivided into a suction chamber (not shown) into which a gas refrigerant is sucked and a compression chamber (not shown) where a sucked gas refrigerant is compressed.

In the compression mechanism section 9, radius dimensions of the eccentric portions 13 and 14 are denoted by "Rc"; an inner diameter dimension of the insertion portion 48 is denoted by "Dp"; eccentricities which are distances from the rotation center "X" of the rotating shaft 12 to centers "Y1" and "Y2" of the eccentric portions 13 and 14 are denoted by "e"; and a radial dimension of the inter-eccentric-portion coupling portion 47 is denoted by "Rj." The inter-eccentric-portion coupling portion 47 is formed such that the radial dimension "Rj" is larger than "Dp-Rc-e" and is smaller than "Dp/2." The inner diameter dimension "Dp" of the insertion portion 48 is formed to be larger than diameter dimensions "2Rc" of the eccentric portions 13 and 14.

Escape (relief) portions 51 and 52 are formed at portions facing the eccentric portions 13 and 14 of the outer peripheral portion of the inter-eccentric-portion coupling portion 47 located on a side where the motor section 8 is attached and a side opposite to the side, which are two sides along the axial direction of the rotating shaft 12.

The escape portion 51 located on the side where the motor section 8 is attached as one of the escape portions formed in a shape not jutting out in an outer peripheral direction from the eccentric portion 13. More specifically, the escape portion 51 is formed in a shape of a circular arc having the center "Y1" of the eccentric portion 13 as a center and having a radius dimension "Rk," and the radius dimension "Rk" has the relationship "Rk≤Rc" with the radius dimension "Rc" of the eccentric portion 13. A dimension "K1" along the axial direction of the rotating shaft 12 of the escape portion 51 is formed to be smaller than a thickness dimension "2H" of the partition plate 18 and is formed to be smaller than thickness dimensions "H" of the first and second divisional partition plates 18*b* and 18*c*.

The escape portion 52 located on the side opposite to the side where the motor section 8 is attached as another one of the escape portions formed in a shape not jutting out in an outer peripheral direction from the eccentric portion 14. More specifically, the escape portion 52 is formed in a shape of a circular arc having the center "Y2" of the eccentric portion 14 as a center and having the radius dimension "Rk," and the radius dimension "Rk" has the relationship "Rk≤Rc" with the radius dimension "Rc" of the eccentric portion 14. A dimension "K2" along the axial direction of the rotating shaft 12 of the escape portion 52 is formed to be smaller than the thickness dimension "2H" of the partition plate 18 and is formed to be equal to the thickness dimensions "H" of the first and second divisional partition plates 18*b* and 18*c*.

FIG. 3 includes explanatory views showing a procedure for assembling the partition plate 18 to the outer peripheral portion of the inter-eccentric-portion coupling portion 47.

Figure 3D:
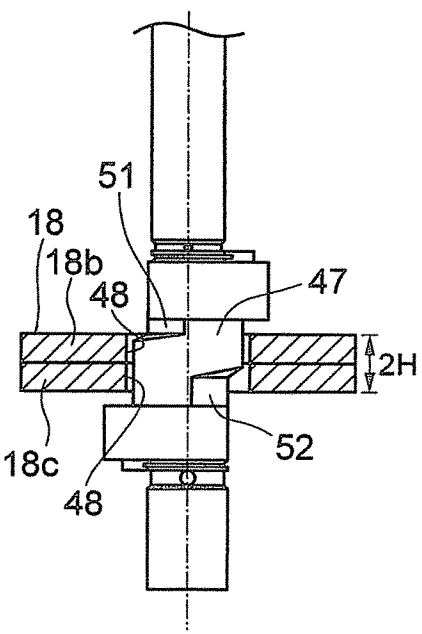
FIG. 3 includes FIGS. 3A to 3D, which are explanatory views showing a procedure for assembling a partition plate to an outer peripheral portion of a coupling portion between eccentric portions.
Figure 3C:
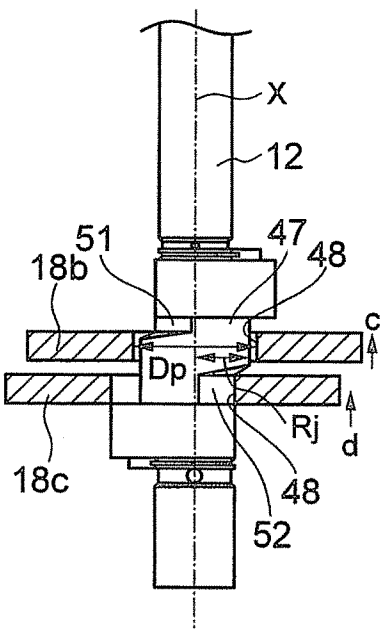
Figure 3B:
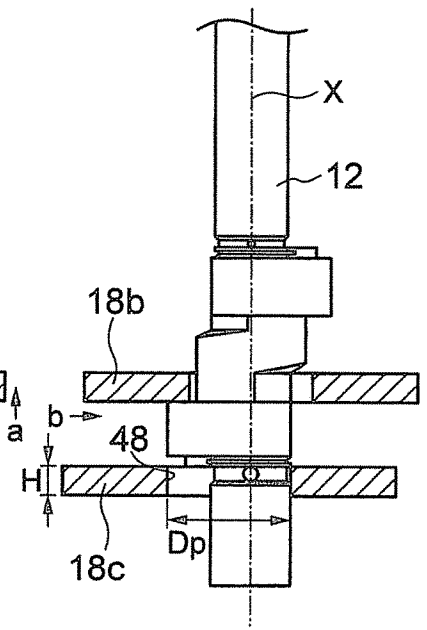
Figure 3A:
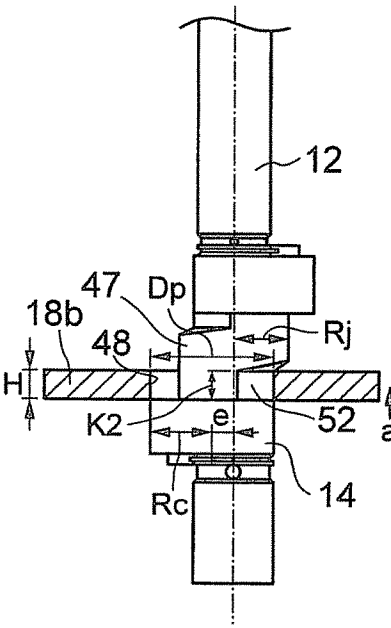

In the state shown in FIG. 3A, the escape portion 52 of the inter-eccentric-portion coupling portion 47 is inserted in the insertion portion 48 of the first divisional partition plate 18*b*. The escape portion 52 is inserted into the insertion portion 48 of the first divisional partition plate 18*b* by moving the first divisional partition plate 18*b* in a direction of an arrow "a" from the side opposite to the side where the motor section 8 is attached of the rotating shaft 12. Since the inner diameter dimension "Dp" of the insertion portion 48 is formed to be larger than the diameter dimension "2Rc" of the eccentric portion 14, the insertion portion 48 passes by an outer periphery of the eccentric portion 14. Furthermore, since the escape portion 52 is formed in the shape not jutting out in the outer peripheral direction from the eccentric portion 14, and the dimension "K2" along the axial direction of the rotating shaft 12 of the escape portion 52 is equal to the thickness dimension "H" of the first divisional partition plate 18*b*, the escape portion 52 of the inter-eccentric-portion coupling portion 47 is inserted into the insertion portion 48 of the first divisional partition plate 18*b*, as shown in FIG. 3A.

In the state shown in FIG. 3B, the first divisional partition plate 18*b*, in which the escape portion 52 is inserted in the insertion portion 48, has been moved in a direction of an arrow "b" orthogonal to the rotation center "X" of the rotating shaft 12. An end portion on the side opposite to the side where the motor section 8 is attached of the rotating shaft 12 is inserted in the insertion portion 48 of the second divisional partition plate 18*c*.

In the state shown in FIG. 3C, the first divisional partition plate 18*b* has been moved in a direction of an arrow "c" which is a direction along the rotation center "X" of the rotating shaft 12 toward the side where the motor section 8 is attached, and the inter-eccentric-portion coupling portion 47 is inserted in the insertion portion 48. Since the radius dimension "Rj" of the inter-eccentric-portion coupling portion 47 is smaller than the radius dimension "Dp/2" of the insertion portion 48, the inter-eccentric-portion coupling portion 47 can be inserted into the insertion portion 48. Further, the second divisional partition plate 18*c* has been moved in a direction of an arrow "d," and the escape portion 52 is inserted in the insertion portion 48.

In the state shown in FIG. 3D, the inter-eccentric-portion coupling portion 47 is inserted in the insertion portions 48 of the first and second divisional partition plates 18*b* and 18*c*, and the first divisional partition plate 18*b* and the second divisional partition plate 18*c* have been coupled to form the partition plate 18.

Forming the in-partition-plate muffler chamber 18*a* in the partition plate 18 in the above-described configuration makes the thickness dimension "2H" of the partition plate 18 larger than a thickness dimension of a different partition plate without the in-partition-plate muffler chamber 18*a*. The larger thickness dimension "2H" of the partition plate 18 leads to a larger dimension along the axial direction of the inter-eccentric-portion coupling portion 47 that is a portion of the rotating shaft 12, to which the partition plate 18 is assembled.

Further, in the conventional hermetic-type compressor having no escape portion 52 to the coupling portion between the eccentric portions, if the radius dimension of the coupling portion between the eccentric portions is not made smaller than "Dp-Rc-e" in which "Rc" is a radius dimension of each of eccentric portions, "Dp" is an inner diameter dimension of an insertion portion of the partition plate, and "e" is an eccentricity which is a distance from a rotation center "X" of a rotating shaft to a center of each eccentric portion, the partition plate cannot be assembled the outer peripheral portion of the coupling portion 47 between the eccentric portions.

In contrast, in the hermetic-type compressor 2A according to the present embodiment, the escape portion 52 is formed at the inter-eccentric-portion coupling portion 47, and the partition plate 18 is formed as the divided first and second divisional partition plates 18*b* and 18*c*. According to such configuration, even if the radius dimension "Rj" of the coupling portion 47 is formed to be larger than "Dp-Rc-e," the partition plate 18 to the outer peripheral portion thereof 47 can be assembled during the procedure described above with reference to FIGS. 3A to 3D.

Thus, even if the length in the axial direction of the coupling portion 47 between the eccentric portions becomes larger in the hermetic-type compressor 2A, if the diameter of the coupling portion 47 increases, the coupling portion 47 is hardly flexed at the time when the rotating shaft rotates, thus enhancing rigidity of the rotating shaft 12. The hermetic-type compressor 2A with high reliability can thus be obtained.

In addition, since the center of the coupling portion 47 between the eccentric portions coincides with the rotation center "X" of the rotating shaft 12, the rotation imbalance caused by centrifugal force during rotation is effectively suppressed.

Since the escape portion 51 is formed in the shape of the circular arc having the center "Y1" of the eccentric portion 13 as the center, the escape portion 51 can be formed continuously to the formation of the eccentric portion 13, thus easily forming the escape portion 51. Similarly, since the escape portion 52 is formed in the shape of the circular arc having the center "Y2" of the eccentric portion 14 as the center, the escape portion 52 can be formed continuously to the formation of the eccentric portion 14, thus easily forming the escape portion 52.

Further, it is to be noted that the one escape portion 51 formed on the motor section 8 side is not required for the assembling of the first and second divisional partition plates 18*b* and 18*c*. However, the formation of the escape portion 51 can prevent an end portion of the roller 23 fitted on the eccentric portion 13 from interfering with the coupling portion 47 between the eccentric portions if the end portion of the roller 23 projects toward the coupling portion 47. The escape portion 52 is utilized to assemble the first and second divisional partition plates 18*b* and 18*c*, and the formation of the escape portion 52 can prevent an end portion of the roller 24 fitted on the eccentric portion 14 from interfering with the coupling portion 47 if the end portion of the roller 24 projects toward the inter-eccentric-portion coupling portion 47.

The present embodiment has been described in a case, as an example, where the dimension "K2" along the axial direction of the rotating shaft 12 of the escape portion 52 is formed to be equal to the thickness dimensions "H" of the first and second divisional partition plates 18*b* and 18*c*.

As for such dimensions, the dimension "K2" of the escape portion 52 may be made smaller than the thickness dimensions "H" of the first and second divisional partition plates 18*b* and 18*c* as long as the coupling portion 47 between the eccentric portions can be inserted into the insertion portion 48. The smaller dimension "K2" of the escape portion 52 enhances rigidity of the coupling portion 47 and further suppresses the imbalance in rotation caused by the centrifugal force during the rotation.

Third Embodiment

Figure 4:
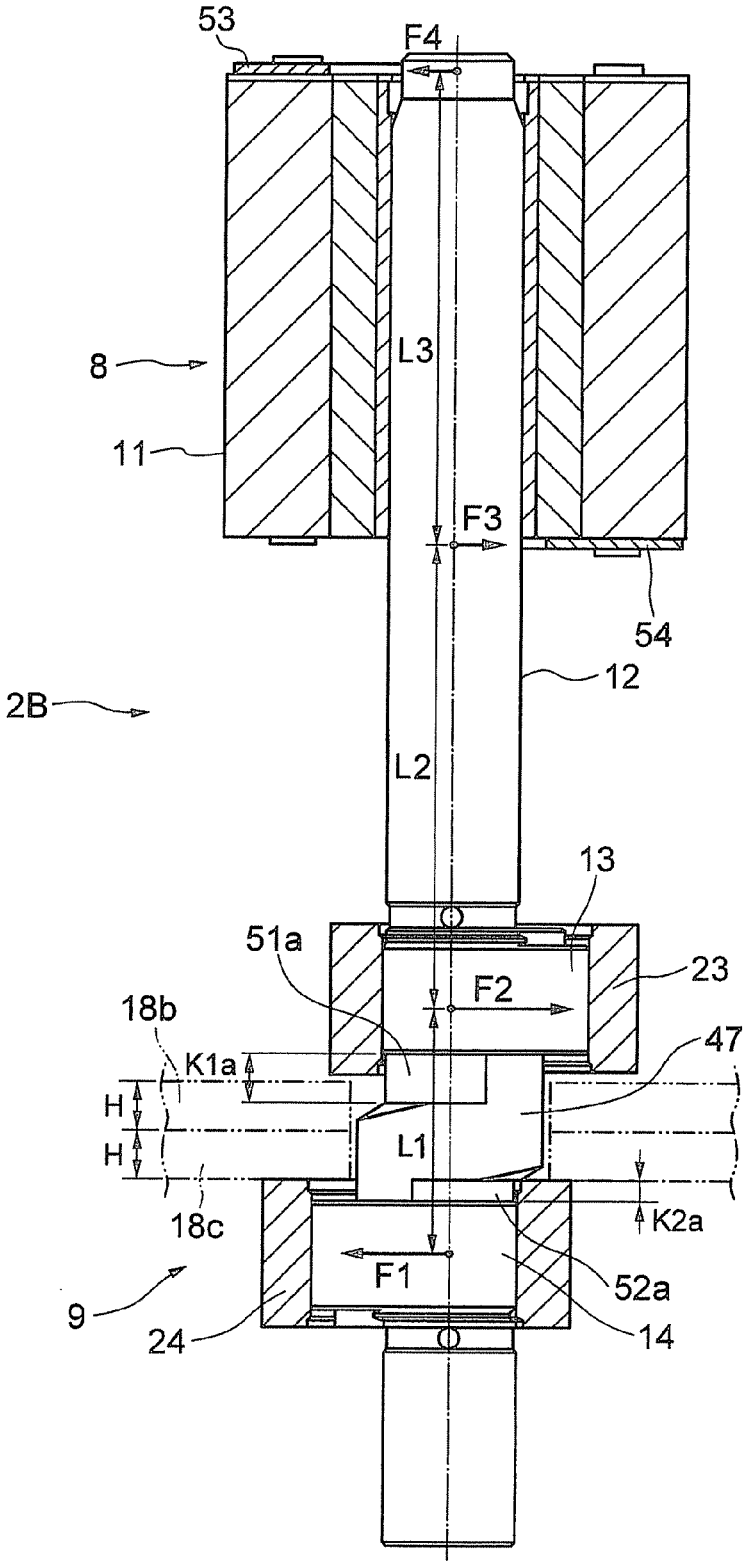
FIG. 4 is a vertical sectional view showing a portion of a hermetic-type compressor according to a third embodiment of the present invention.

A third embodiment of the present invention will be described hereunder with reference to FIG. 4. A basic configuration of a hermetic-type compressor 2B according to the present third embodiment is the same as that of the hermetic-type compressor 2A according to the second embodiment.

A motor section 8, a compression mechanism section 9, and a rotating shaft 12 are housed in a closed case 7 (see FIG. 2).

The third embodiment is different from the second embodiment in that first and second divisional partition plates 18*b* and 18*c* to an outer peripheral portion of an inter-eccentric-portion coupling portion 47 is assembled from a side where the motor section 8 is attached along an axial direction of the rotating shaft 12.

In the hermetic-type compressor 2B, escape portions 51*a* and 52*a* are formed at portions facing eccentric portions 13 and 14 of the outer peripheral portion of the coupling portion 47 between the eccentric portions 13 and 14 (inter-eccentric-portion coupling portion 47) so as to be located on the side where the motor section 8 is attached and a side opposite to this side, which are two sides along the axial direction of the rotating shaft 12.

The escape portion 51*a* located on the side where the motor section 8 is attached as one of the escape portions is formed such that a dimension "K1a" along the axial direction of the rotating shaft 12 is formed to be equal to thickness dimensions "H" of the first and second divisional partition plates 18*b* and 18*c*.

The escape portion 52*a* located on the side opposite to the side where the motor section 8 is attached as another one of the escape portions is formed such that a dimension "K2a" along the axial direction of the rotating shaft 12 is formed to be equal to the thickness dimensions "H" of the first and second divisional partition plates 18*b* and 18*c*.

Balancers 53 and 54 are attached to a rotor 11 of the motor section 8 on two sides along the axial direction of the rotating shaft 12.

Here, It is supposed that "F1" be a centrifugal force derived from the eccentric portion 14, a roller 24, and the escape portion 52*a*, which are located on the side opposite to the side where the motor section 8 is attached along the axial direction of the rotating shaft 12, when the rotating shaft 12 is rotating; "F2," a centrifugal force derived from the eccentric portion 13, a roller 23, and the escape portion 51*a*, which are located on the side where the motor section 8 is attached along the axial direction of the rotating shaft 12; "F3," a centrifugal force derived from the lower balancer 54; and "F4," a centrifugal force derived from the upper balancer 53. Also, let "L1" be a distance between "F1" and "F2"; "L2," a distance between "F2" and "F3"; and "L3," a distance between "F3" and "F4." In this case, a relational expression of moment about a position of the lower balancer 54 is given by:

$$\text{"}F1\cdot(L1+L2)=F2\cdot L2+F4\cdot L3\text{"}$$

Since the centrifugal force "F4" at a position of the upper balancer 53 serves as a cantilever load for the rotating shaft 12, "F4" is desirably minimized to prevent the rotating shaft 12 from being flexed. In order to reduce "F4," it is necessary to reduce "F1" and increase "F2" in the above expression. That is, it is necessary to make the dimension "K1a" of the escape portion 51*a* located on the side to which the motor section 8 is attached larger than the dimension "K2a" of the escape portion 52*a* located on the side opposite to the side of the motor section 8, in the escape portions 51*a* and 52*a* of the coupling portion 47 between the eccentric portions.

In the third embodiment of the structure or configuration mentioned above, the escape portions 51*a* and 52*a* are formed at the coupling portion 47, the dimension "K1a" of the escape portion 51*a* located on the motor attachment side is designed to be larger than the dimension "K2a" of the escape portion 52*a* located on the side opposite to the side to which the motor section 8 is attached, and the first and second divisional partition plates 18*b* and 18*c* are assembled to the outer peripheral portion of the coupling portion 47 from the motor attachment side of the rotating shaft 12. This allows reduction in a load acting on the rotating shaft 12 in a cantilever state when the rotating shaft 12 is rotating and allows enhancement of reliability of the hermetic-type compressor 2B.

According to the above-described embodiment, a first bearing discharge port 31 which is formed in the first bearing 15 and the first partition plate discharge port 35 which is formed in the partition plate 18 are provided as discharge ports through which a gas refrigerant, serving as a working fluid, compressed in a first cylinder chamber 17*a* is discharged into a space in the closed case 7, and the second bearing discharge port which is formed in the second bearing and the second partition plate discharge port which is formed in the partition plate are provided as discharge ports through which a working fluid compressed in the second cylinder chamber 19*a* is discharged into the space in the closed case 7. Thus, the discharge ports, through which a compressed gas refrigerant is discharged, have a large area, and pressure loss produced when a working fluid passes through the discharge ports can be suppressed.

In addition, the cross-sectional area of the first partition plate discharge port 35 is formed to be smaller than a cross-sectional area of the first bearing discharge port 31, and the cross-sectional area of the second partition plate discharge port 42 is formed to be smaller than the cross-sectional area of the second bearing discharge port 38. According to this configuration, the amount of gas refrigerant discharged into an in-partition-plate muffler chamber 18*a* serving as an in-partition-plate space through the first partition plate discharge port 35 and the second partition plate discharge port 42 is made smaller. Even if the volume of the in-partition-plate muffler chamber 18*a* becomes small, the pressure pulsation of the gas refrigerant discharged into the in-partition-plate muffler chamber 18*a* can be dampened, and hence, the generation of noise caused by pressure pulsation can be suppressed. Furthermore, by reducing the volume of the in-partition-plate muffler chamber 18*a*, the thickness of the partition plate 18 can be also reduced, and also by reducing the thickness of the partition plate 18, the interval between the first bearing 15 and the second bearing 20 can be reduced. The reduction in the interval between the first bearing 15 and the second bearing 20 can prevent the uneven contact of the rotating shaft 12 with the first bearing 15 and the second bearing 20 and also prevent the flexure of the rotating shaft 12, thereby enhancing the performance of the hermetic-type compressor 2B.

Another Embodiment

Although the above mentioned first to third embodiment of the present invention provide various examples of the hermetic-type compressor, the prevent invention may further provide another embodiment relating to a refrigeration cycle apparatus (the refrigeration cycle apparatus 1 in FIG. 1) including the hermetic-type compressor of each of the above embodiments.

That is, a refrigeration cycle apparatus 1 according to the present embodiment has a hermetic-type compressor 2, a condenser 3 which is connected to the hermetic-type compressor 2, an expansion device 4 which is connected to the condenser 3, an evaporator 5 which is connected to the expansion device 4, and an accumulator 6 which is connected between the evaporator 5 and the hermetic-type compressor 2, as shown in FIG. 1. In the condenser 3 in the above-described configuration, a gas refrigerant guided from a space in a closed case 7 is condensed into a liquid refrigerant. In the expansion device 4, the liquid refrigerant obtained through the condensation in the condenser 3 is decompressed. In the evaporator 5, the liquid refrigerant decompressed in the expansion device 4 evaporates into a gas refrigerant. In the accumulator 6, if a liquid refrigerant is included in the gas refrigerant obtained through the evaporation in the evaporator 5, the liquid refrigerant is removed.

As described above, in the refrigeration cycle apparatus 1, a refrigerant serving as a working fluid circulates while changing in phase between a gas refrigerant in gaseous form and a liquid refrigerant in liquid form. The refrigerant dissipates heat in a phase change process from a gas refrigerant to a liquid refrigerant and absorbs heat in a phase-change process from the liquid refrigerant to the gas refrigerant. The heat dissipation and heat absorption are utilized to perform air heating, air cooling, heating, cooling, and the like.

By applying the hermetic-type compressor according to each of the above-described first to third embodiments to the hermetic-type compressor in the refrigeration cycle apparatus 1, the intended object of the present invention can be attained.

It should be further noted that although the embodiments of the present invention are described above, these embodiments are provided only as examples and are not intended to limit scope of the invention. The novel embodiments may be embodied in various other modes, and omissions, alternations, and changes may be made without departing from spirit of the present invention, and these embodiments and their modifications are included in the scope and spirit of the present invention and are included in the invention described in the claims and scopes equivalent thereto.

INDUSTRIAL APPLICABILITY

A hermetic-type compressor according to the present invention can suppress the pressure loss produced when a working fluid compressed in a cylinder chamber passes through a discharge port, can dampen the pressure pulsation of a working fluid discharged through a discharge port of a partition plate to achieve reduction in thickness of the partition plate, and can make a diameter of a coupling portion between eccentric portions of a rotating shaft larger to thereby enhance the rigidity of the rotating shaft. Thus, a refrigeration cycle apparatus including a compact, high-rigidity hermetic-type compressor can be provided, which leads to further increase in industrial applicability.

REFERENCE NUMERAL

1 - - - refrigeration cycle apparatus, 2 - - - hermetic-type compressor, 3 - - - condenser, 4 - - - expansion device, 5 - - - evaporator, 7 - - - closed case, 8 - - - motor section, 9 - - - compression mechanism section, 12 - - - rotating shaft, 13, 14 - - - eccentric portion, 15 - - - first bearing, 17 - - - first cylinder, 16*a* - - - first muffler chamber, 17*a* - - - first cylinder chamber, 18 - - - partition plate, 18*a* - - - in-partition-plate-muffler chamber (in-partition-plate space), 18*b* - - - first divisional partition plate (divided partition plate), 18*c* - - - second divisional partition plate (divided partition plate), 19 - - - second cylinder, 19*a* - - - second cylinder chamber, 21*a* - - - second muffler chamber, 23, 24 - - - roller, 28 - - - positioning member, 29 - - - engaging portion, 30 - - - engagement portion, 31 - - - first bearding discharge port, 32 - - - discharge valve, 35 - - - first partition plate discharge port, 36 - - - discharge valve, 38 - - - second bearding discharge port, 39 - - - discharge valve, 42 - - - second partition plate discharge port, 43 - - - discharge valve, 45 - - - first discharge passage, 46 - - - second discharge passage, 47 - - - coupling portion between eccentric portions (inter-eccentric-portion coupling portion), 48 - - - insertion portion, 51*a* - - - escape portion, 52 - - - escape portion, 52*a* - - - escape portion.

The invention claimed is:

1. A hermetic type compressor comprising a closed case, a motor portion which is housed in the closed case, and a compression mechanism portion which is housed in the closed case and is driven by a rotating shaft coupled to the motor portion so as to compress a working fluid, the compression mechanism portion including a first bearing, a first cylinder, a partition plate, a second cylinder, and a second bearing, which are provided in order along an axial direction of the rotating shaft, and having a first cylinder chamber formed in the first cylinder closed at two ends by the first bearing and the partition plate so as to compress the working fluid and a second cylinder chamber formed in the second cylinder closed at two ends by the partition plate and the second bearing so as to compress the working fluid, in which the working fluid compressed in the first cylinder chamber and the working fluid compressed in the second cylinder chamber are discharged into a space in the closed case, wherein an in-partition-plate space which communicates with the space in the closed case is formed inside the partition plate, the compressor is provided, as discharge ports through which the working fluid compressed in the first cylinder chamber is discharged into the space in the closed case, with a first bearing discharge port formed in the first bearing and a first partition plate discharge port formed in the partition plate, the compressor is provided, as discharge ports through which the working fluid compressed in the second cylinder chamber is discharged into the space in the closed case, with a second bearing discharge port formed in the second bearing and a second partition plate discharge port formed in the partition plate, and a cross-sectional area of the first partition plate discharge port is formed to be smaller than a cross-sectional area of the first bearing discharge port, and a cross-sectional area of the second partition plate discharge port is formed to be smaller than a cross-sectional area of the second bearing discharge port.

2. The hermetic-type compressor according to claim 1, wherein the rotating shaft has eccentric portions, which are located in the first and second cylinder chambers, have centers deviating from a rotation center of the rotating shaft, rollers are fitted to outer peripheral portions of the eccentric portions, and an inter-eccentric-portion coupling portion, which is located between the eccentric portions, and has a center coincident with the rotation center of the rotating shaft, the partition plate is formed by coupling a plurality of divisional plates divided along the axial direction of the rotating shaft, the partition plate having an insertion portion in which the inter-eccentric-portion coupling portion is inserted, and the inter-eccentric-portion coupling portion is formed in a solid cylinder shape having a radius dimension "Rj" larger than "Dp-Rc-e" and smaller than "Dp/2," where "Rc" is a radius dimension of each of the eccentric portions, "Dp" is an inner diameter dimension of the insertion portion, and "e" is an eccentricity which is a distance from the rotation center of the rotating shaft to the center of each eccentric portion, and escape portions, which provide a shape not protruding in outer peripheral directions from the eccentric portions and have dimensions along the axial direction of the rotating shaft which are smaller than a thickness dimension of the partition plate, are formed at portions facing the eccentric portions of an outer peripheral portion of the inter-eccentric-portion coupling portion.

3. The hermetic-type compressor according to claim 1, wherein a discharge valve which opens or closes the first partition plate discharge port has a maximum degree of opening that is set to be smaller than a maximum degree of opening of a discharge valve which opens or closes the first bearing discharge port, and a discharge valve which opens or closes the second partition plate discharge port has a maximum degree of opening is set to be smaller than a maximum degree of opening of a discharge valve which opens or closes the second bearing discharge port.

4. The hermetic-type compressor according to claim 1, wherein the first cylinder is arranged above the second cylinder, a first muffler chamber which communicates with the first bearing discharge port and a second muffler chamber which communicates with the second bearing discharge port are provided, a first discharge passage communicating the in-partition-plate space and the first muffler chamber with each other and a second discharge passage communicating the in-partition-plate space and the second muffler chamber with each other are provided, and a cross-sectional area of the first discharge passage is formed to be larger than a cross-sectional area of the second discharge passage.

5. The hermetic-type compressor according to claim 1, wherein the partition plate is formed by coupling two divisional partition plates divided along the axial direction of the rotating shaft, a positioning member having two protruding ends is provided at one of the divisional partition plates, and engagement portions to be engaged with the positioning member are formed at another one of the divisional partition plates and the first cylinder or the second cylinder.

6. The hermetic-type compressor according to claim 2, wherein the escape portions are formed on a side where the motor section is attached and a side opposite to the first mentioned side along the axial direction of the rotating shaft, and the dimensions along the axial direction of the rotating shaft of the escape portions are formed such that the dimension of one of the escape portions located on the side where the motor section is attached is larger than the dimension of another one of the escape portions located on the side opposite to the first mentioned side.

7. A refrigerant cycle apparatus comprising a hermetic-type compressor according to claim 1, a condenser which is connected to the hermetic-type compressor, an expansion device which is connected to the condenser, and an evaporator which is connected between the expansion device and the hermetic-type compressor.

8. The hermetic-type compressor according to claim 2, wherein a discharge valve which opens or closes the first partition plate discharge port has a maximum degree of opening that is set to be smaller than a maximum degree of opening of a discharge valve which opens or closes the first bearing discharge port, and a discharge valve which opens or closes the second partition plate discharge port has a maximum degree of opening is set to be smaller than a maximum degree of opening of a discharge valve which opens or closes the second bearing discharge port.

9. The hermetic-type compressor according to claim 2, wherein the first cylinder is arranged above the second cylinder, a first muffler chamber which communicates with the first bearing discharge port and a second muffler chamber which communicates with the second bearing discharge port are provided, a first discharge passage communicating the in-partition-plate space and the first muffler chamber with each other and a second discharge passage communicating the in-partition-plate space and the second muffler chamber with each other are provided, and a cross-sectional area of the first discharge passage is formed to be larger than a cross-sectional area of the second discharge passage.

10. The hermetic-type compressor according to claim 3, wherein the first cylinder is arranged above the second cylinder, a first muffler chamber which communicates with the first bearing discharge port and a second muffler chamber which communicates with the second bearing discharge port are provided, a first discharge passage communicating the in-partition-plate space and the first muffler chamber with each other and a second discharge passage communicating the in-partition-plate space and the second muffler chamber with each other are provided, and a cross-sectional area of the first discharge passage is formed to be larger than a cross-sectional area of the second discharge passage.

11. The hermetic-type compressor according to claim 2, wherein the partition plate is formed by coupling two divisional partition plates divided along the axial direction of the rotating shaft, a positioning member having two protruding ends is provided at one of the divisional partition plates, and engagement portions to be engaged with the positioning member are formed at another one of the divisional partition plates and the first cylinder or the second cylinder.

12. The hermetic-type compressor according to claim 3, wherein the partition plate is formed by coupling two divisional partition plates divided along the axial direction of the rotating shaft, a positioning member having two protruding ends is provided at one of the divisional partition plates, and engagement portions to be engaged with the positioning member are formed at another one of the divisional partition plates and the first cylinder or the second cylinder.

13. The hermetic-type compressor according to claim 4, wherein the partition plate is formed by coupling two divisional partition plates divided along the axial direction of the rotating shaft, a positioning member having two protruding ends is provided at one of the divisional partition plates, and engagement portions to be engaged with the positioning member are formed at another one of the divisional partition plates and the first cylinder or the second cylinder.

14. A refrigerant cycle apparatus comprising a hermetic-type compressor according to claim 2, a condenser which is connected to the hermetic-type compressor, an expansion device which is connected to the condenser, and an evaporator which is connected between the expansion device and the hermetic-type compressor.

15. A refrigerant cycle apparatus comprising a hermetic-type compressor according to claim 3, a condenser which is connected to the hermetic-type compressor, an expansion device which is connected to the condenser, and an evaporator which is connected between the expansion device and the hermetic-type compressor.

16. A refrigerant cycle apparatus comprising a hermetic-type compressor according to claim 4, a condenser which is connected to the hermetic-type compressor, an expansion device which is connected to the condenser, and an evaporator which is connected between the expansion device and the hermetic-type compressor.

17. A refrigerant cycle apparatus comprising a hermetic-type compressor according to claim 5, a condenser which is connected to the hermetic-type compressor, an expansion device which is connected to the condenser, and an evaporator which is connected between the expansion device and the hermetic-type compressor.

18. A refrigerant cycle apparatus comprising a hermetic-type compressor according to claim 6, a condenser which is connected to the hermetic-type compressor, an expansion device which is connected to the condenser, and an evaporator which is connected between the expansion device and the hermetic-type compressor.

* * * * *